US007686629B1

(12) United States Patent
Yu et al.

(10) Patent No.: US 7,686,629 B1
(45) Date of Patent: Mar. 30, 2010

(54) ELECTRONIC DEVICE WITH A SLIDING PROTECTIVE CAP

(75) Inventors: David Yu, Lake Forest, CA (US); Stan Wang, Irvine, CA (US); Benjamin Larelle, Colton, CA (US)

(73) Assignee: Avio Corporation, Santa Ana, CA (US)

( * ) Notice: Subject to any disclaimer, the term of this patent is extended or adjusted under 35 U.S.C. 154(b) by 0 days.

(21) Appl. No.: 12/258,865

(22) Filed: Oct. 27, 2008

(51) Int. Cl.
*H01R 13/44* (2006.01)

(52) U.S. Cl. ..... 439/136; 439/147

(58) Field of Classification Search ..... 439/131, 439/136, 138, 147
See application file for complete search history.

(56) References Cited

U.S. PATENT DOCUMENTS 6,456,500 B1 * 9/2002 Chen ..... 361/752
6,561,421 B1 * 5/2003 Yu ..... 235/451
6,612,853 B2 * 9/2003 Wu ..... 439/136
7,241,153 B2 * 7/2007 He et al. ..... 439/148
7,503,780 B1 * 3/2009 Huang ..... 439/135
7,568,942 B1 * 8/2009 Lannon et al. ..... 439/521

* cited by examiner

*Primary Examiner*—Truc T Nguyen
(74) *Attorney, Agent, or Firm*—Charles C. H. Wu; Wu & Cheng, LLP

(57) ABSTRACT

An electronic device is provided for connecting to an external device. The electronic device includes a main body, a connector at a proximal end of the main body, a bottom case coupled to the main body at a distal end, and a top case slidably located opposite to the bottom case. The electronic device further includes a first cantilever locking arm and a second cantilever retaining arm on at least one side of the main body. The top case is slid towards the bottom case to expose the connector and the top case is slid towards the connector to cover the connector. The first cantilever locking arm includes an open locking mechanism and a close locking mechanism for maintaining the top case in an open state and a closed state respectively. The second cantilever retaining arm retains the top case on the main body.

12 Claims, 10 Drawing Sheets

ELECTRONIC DEVICE WITH A SLIDING PROTECTIVE CAP

BACKGROUND OF THE INVENTION

1. Technical Field of the Invention

The present invention relates in general to an electronic device having a protective cap. More specifically, the present invention relates to an electronic device having a sliding protective top case that allows the protection of a connector on the electronic device without the need of a sliding button, elastic component, or spring.

2. Description of the Related Art

Electronic device with USB interface has gained immense popularity in recent years. Many businessmen and professional find USB very useful in their work. A Universal Serial Bus (USB) is a small portable memory storage device that is used on computers and other digital devices to transfer data using a USB cable. One of the most desirable features in the USB is that, the computer does not need to be powered off and restart to attach or remove the USB.

Today electronic device with USB interface comes in various attractive shapes, colors, and sizes. Many USB peripherals utilize a protective cover to protect the connecting portion. A common problem associated with most USB devices is the possibility of losing the protective cover due to its small size which may cause physical damage to the USB device. Moreover, it increases the susceptibility to slipping off of the protective cover during normal handling, transport and storage.

With the increased use of USB, various extension and retraction mechanisms are provided for the connecting portion. These mechanisms utilize a sliding button to extend the connector from an enclosure of the USB and to retract the connector when not in use. (See prior art U.S. Pat. No. 6,979,210, Regen, et al.) The operation is inconvenient for an end user. Furthermore, such mechanisms require multiple parts such as button and are complex for manufacturing.

In order to address the need of protection of the connecting portion, Some USB devices have been developed with a sheath for slidably receiving the main body. A positioning component in the sheath fixes the main body when the connection portion is protruded and an elastic component in the sheath presses the main body to store the connecting portion. (See prior art U.S. Pat. No. 7,104,814, She, et al.) Frequent use of such device decreases the durability of the elastic component. Further, the damage of the elastic component makes the device useless.

Many attempts are made to utilize a complex sliding mechanism which includes multiple moving parts with a press button. The sliding mechanism is ejected by pressing on the button. This approach is difficult and very expensive to manufacture.

Some other USB devices utilize a spring to keep the button protruded. Utilization of such a spring increases the thickness of the device due to the implementation of the spring mechanism.

Hence, it can be seen, that there is a need for an electronic device that is capable of eliminating the sliding button and/or elastic component for the protection, capable of utilizing fewer parts. Moreover, the needed device would be durable, economical, and easy to manufacture.

SUMMARY OF THE INVENTION

To minimize the limitations found in the prior art, and to minimize other limitations that will be apparent upon the reading of the specifications, the present invention provides an electronic device having a sliding protective top case that allows the protection of a connector. The electronic device comprises a main body, a connector positioned at a proximal end of the main body, a bottom case coupled to the main body at a distal end, and a top case slidably located opposite to the bottom case. The electronic device further comprises a first cantilever locking arm and a second cantilever retaining arm on at least one side of the main body; wherein the top case is slid towards at least one end of the main body to expose and protect the connector.

In another aspect of the present invention, a method in accordance with the present invention is a method of protecting and exposing a connector comprising of sliding a top case towards a bottom case to achieve an open state, and sliding the top case towards the connector to achieve a closed state; wherein the top case and the bottom case are immediately adjacent to each other when the top case is in the open state and are distally separated when the top case is in the closed state.

One objective of the invention is to provide an electronic device with a slidable protective top case that is capable of exposing and covering the connector.

Another objective of the invention is to provide an electronic device with a stationary main body and a movable top case.

A third objective of the invention is to provide an electronic device featuring a first cantilever locking arm on at least one side of a main body that includes an open locking mechanism and a close locking mechanism for maintaining a top case in an open state and a closed state respectively.

Yet another objective of the invention is to provide an electronic device featuring a second cantilever retaining arm on at least one side of a main body that is capable of retaining a top case on the main body.

Still another objective of the invention is to provide an electronic device featuring a simple design that facilitates ease of manufacturing.

It is also the objective of the invention to provide an electronic device with two holes on a bottom case, each for receiving a strap means for carrying the electronic device.

These and other advantages and features of the present invention are described with specificity so as to make the present invention understandable to one of ordinary skill in the art.

BRIEF DESCRIPTION OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention, thus the drawings are generalized in form in the interest of clarity and conciseness.

DETAILED DESCRIPTION OF THE DRAWINGS

In the following discussion that addresses a number of embodiments and applications of the present invention, reference is made to the accompanying drawings that form a part of hereof, and in which is shown by way of illustration specific embodiments in which the invention may be practiced. It is to be understood that other embodiments may be made without departing from the scope of the present invention.

Various inventive features are described below that can each be used independently of one another or in combination with other features. However, any single inventive feature may not address any of the problems discussed above or only address one of the problems discussed above. Further, one or more of the problems discussed above may not be fully addressed by any of the features described below.

Figure 1:
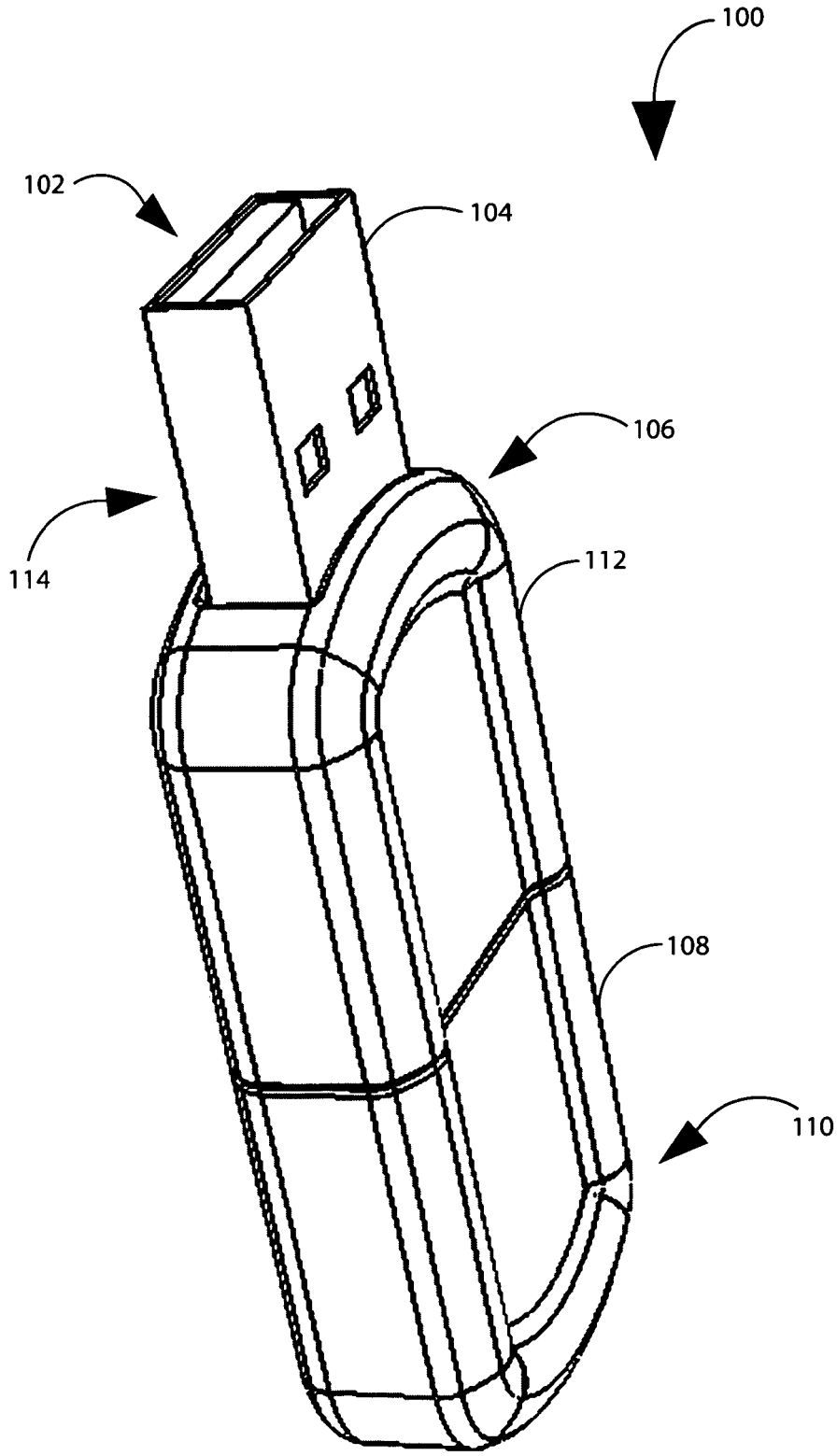
FIG. 1 is a perspective view of the present invention showing the electronic device in the open state.

FIG. 1 shows an overall perspective view of an electronic device 100 in accordance with the present invention.

Electronic device is shown in FIG. 1, with a main body 102 having an on-board memory (not shown) for storing digital information and a connector 104 positioned at a proximal end 106 of the main body 102. The connector 104 is coupled to the on-board memory (not shown). The electronic device 100 further comprises of a bottom case 108 coupled to the main body 102 at a distal end 110 and a top case 112 slidably located opposite to the bottom case 108.

The electronic device 100 in this current exemplary embodiment may have a removable plastic window on the top case 112 in order to insert small graphical card. Moreover, although the top case 112 and the bottom case 108 of the electronic device 100 may be made out of a plastic material as the most common material, these may also be made out of any biodegradable material or any other material capable of offering protection to the connector 104 all without departing from the scope of the present invention.

Finally, FIG. 1 shows the electronic device 100 in an open state 114. Top case 112 in the present invention may be slid towards at least one end of the main body to expose and protect the connector 104.

Top case 112 may be moved towards the bottom case 108 to expose the connector 104 and achieve the open state 114. The top case 112 and the bottom case 108 in this current exemplary embodiment may be immediately adjacent to each other when the top case 112 is in the open state 114. The connector 104 may be able to connect to the external device (not shown) in this open state 114.

Figure 2:
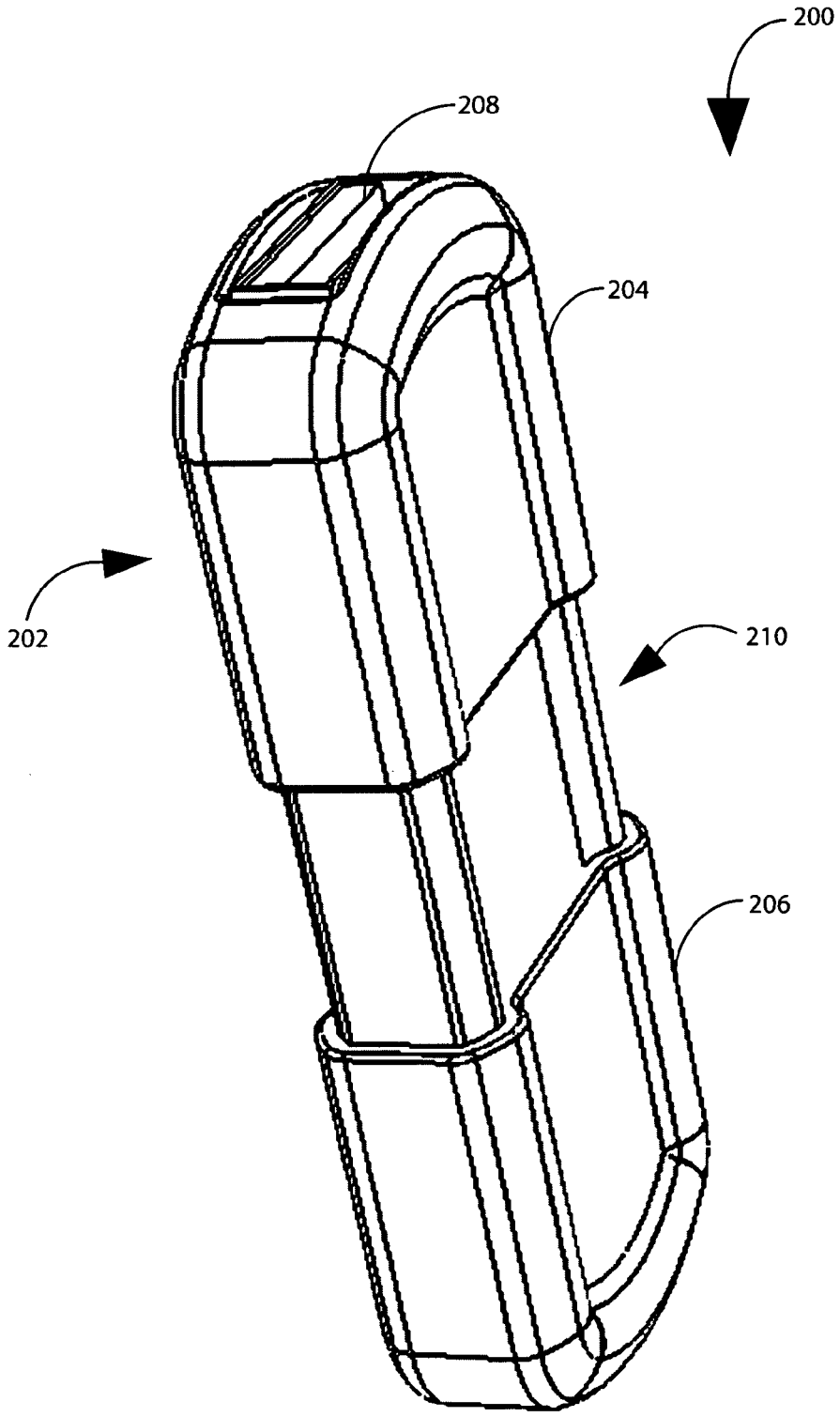
FIG. 2 is a perspective view of the present invention showing the electronic device in the closed state.

FIG. 2 shows a perspective view of the current invention showing the electronic device 200 in a closed state 202.

As in FIG. 2, the top case 204 and the bottom case 206 may be distally separated when the top case 204 is in the closed state 202. This may be achieved by sliding the top case 204 towards the connector 208 to enclose and protect the connector 208. The main body 210 in the current exemplary embodiment may be stationary and the top case 204 may be movable.

Figure 3:
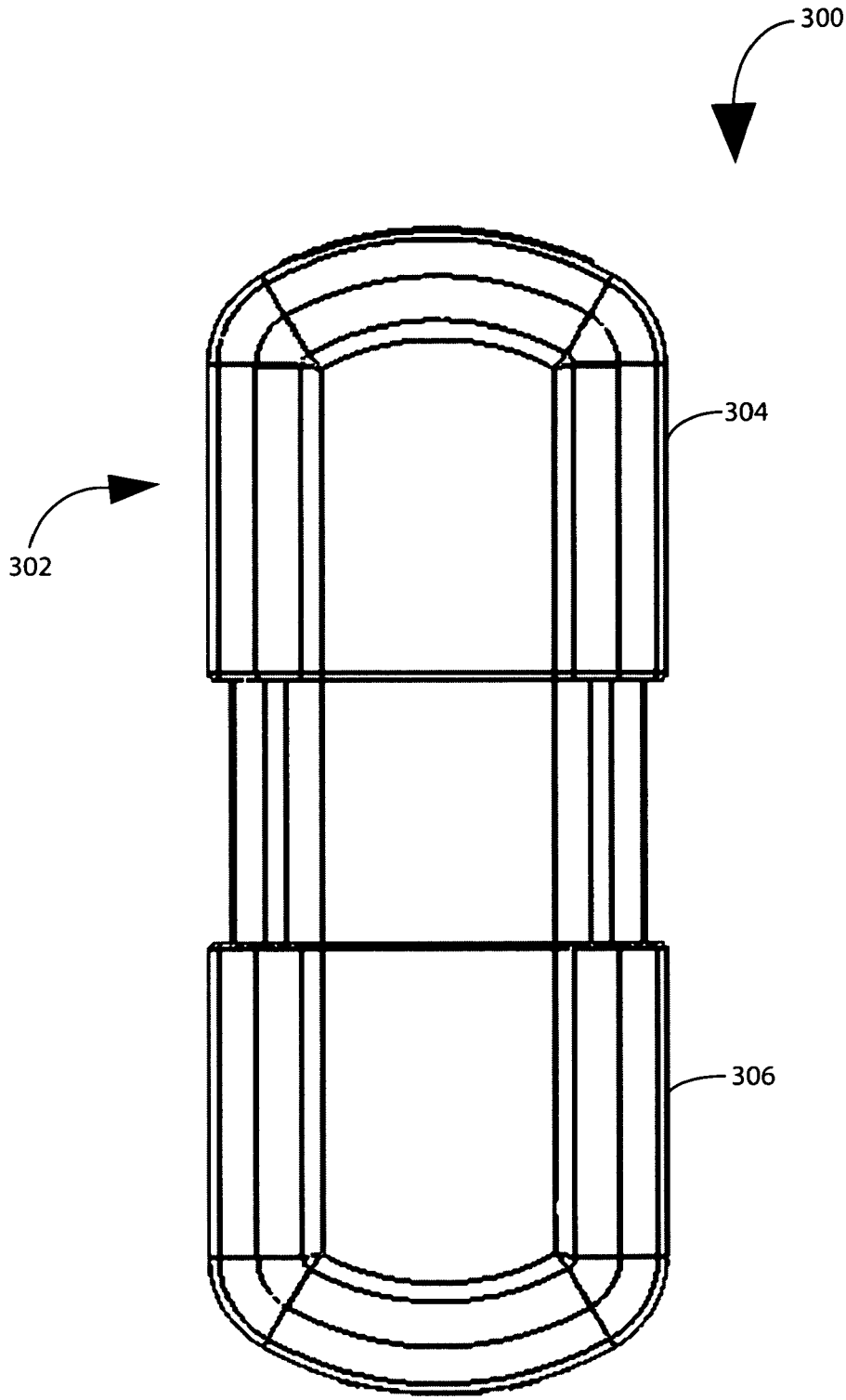
FIG. 3 is a front plan view of the present invention showing the electronic device.

FIG. 3 shows a front plan view of the electronic device 300 in the closed state 302. The top case 304 and the bottom case 306 may be distally separated in this closed state 302.

Figure 4:
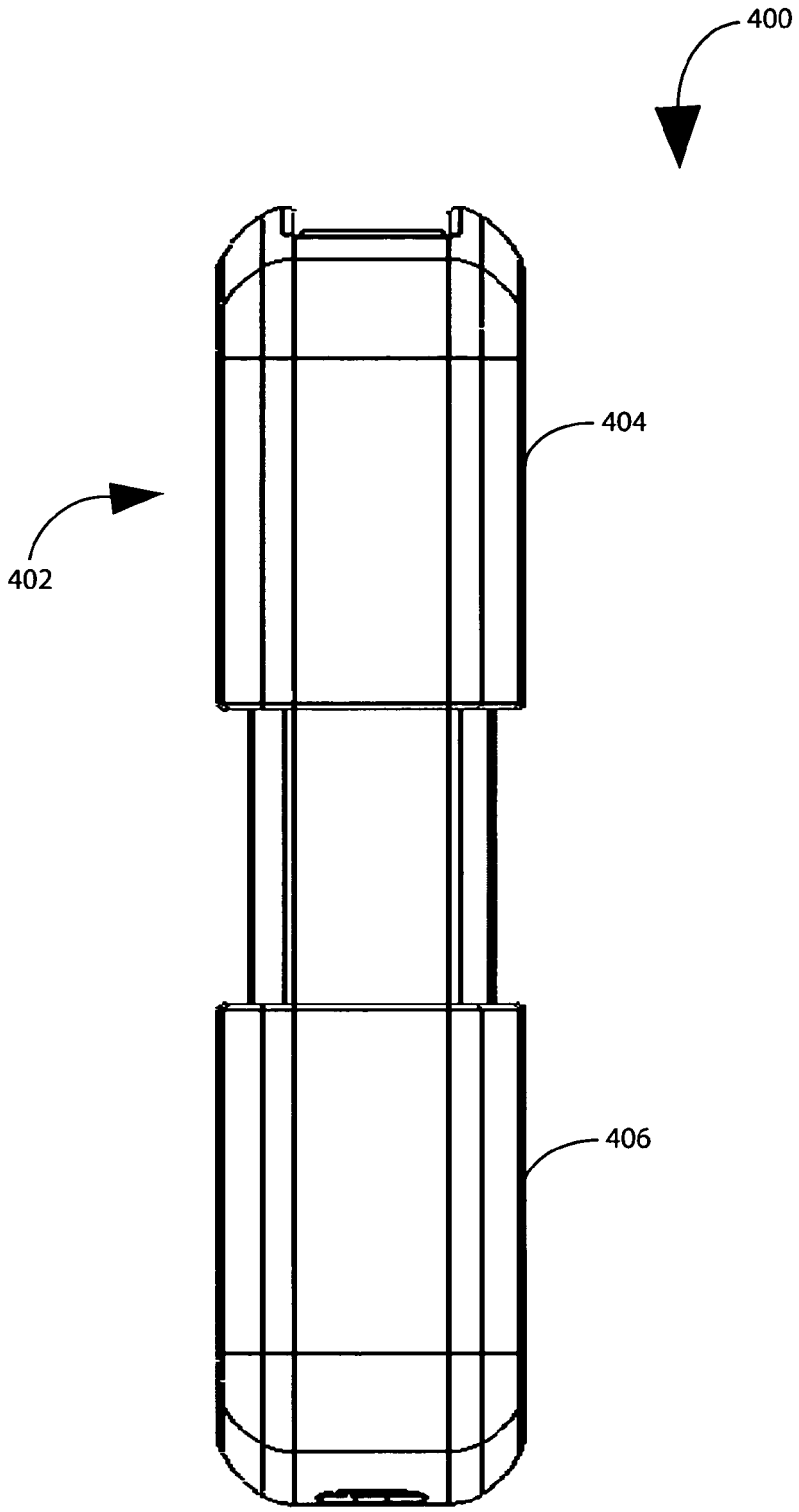
FIG. 4 is a side elevational view of the present invention showing the electronic device.

FIG. 4 shows a side elevational view of the electronic device 400 in the closed state 402.

As seen in FIG. 4, the top case 404 and the bottom case 406 may be distally separated in the closed state 402.

Figure 5:
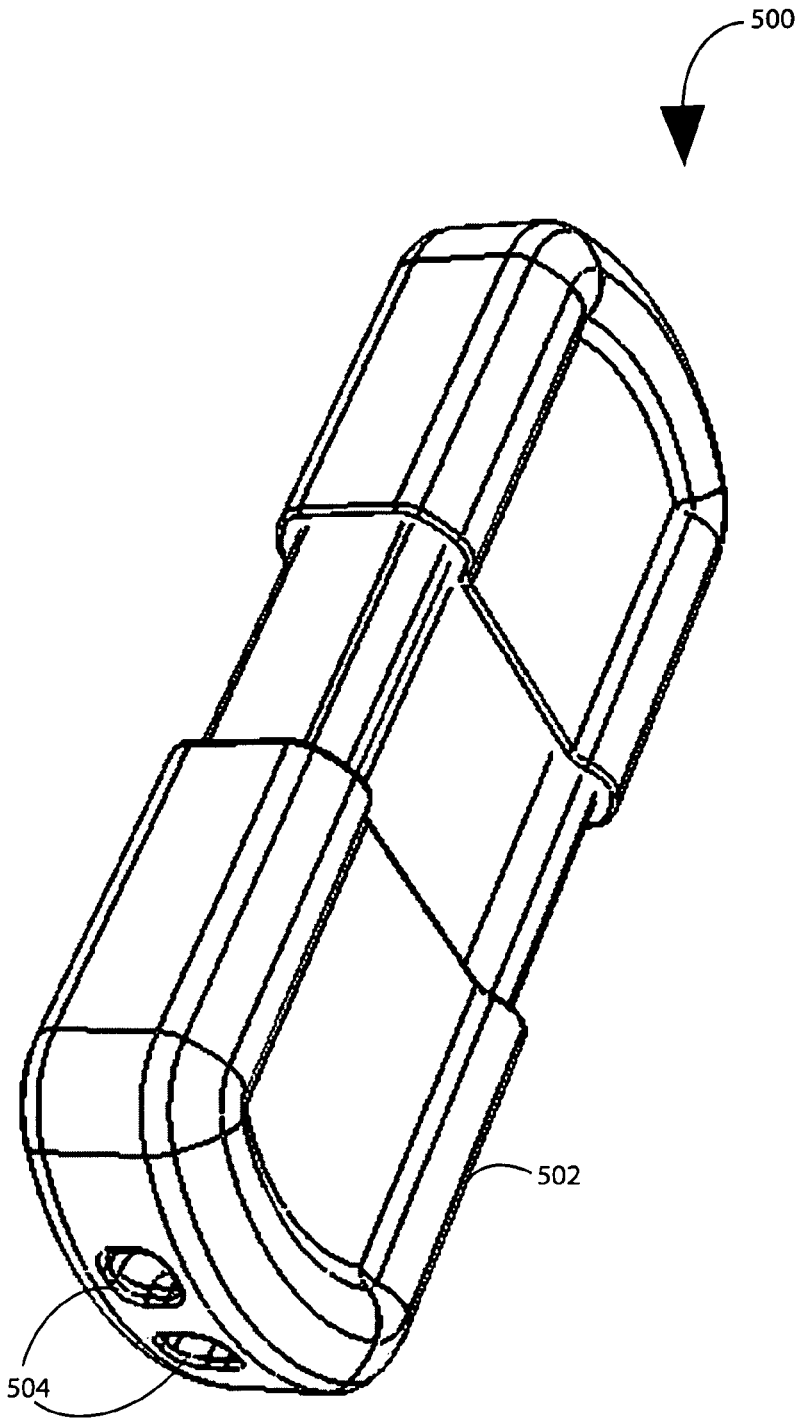
FIG. 5 is a side perspective view of the present invention showing the electronic device.

FIG. 5 shows a side perspective view of the electronic device 500 in accordance with the present invention. Bottom case 502 may include two holes 504, each for receiving a strap means for conveniently carrying the electronic device 500.

Figure 6:
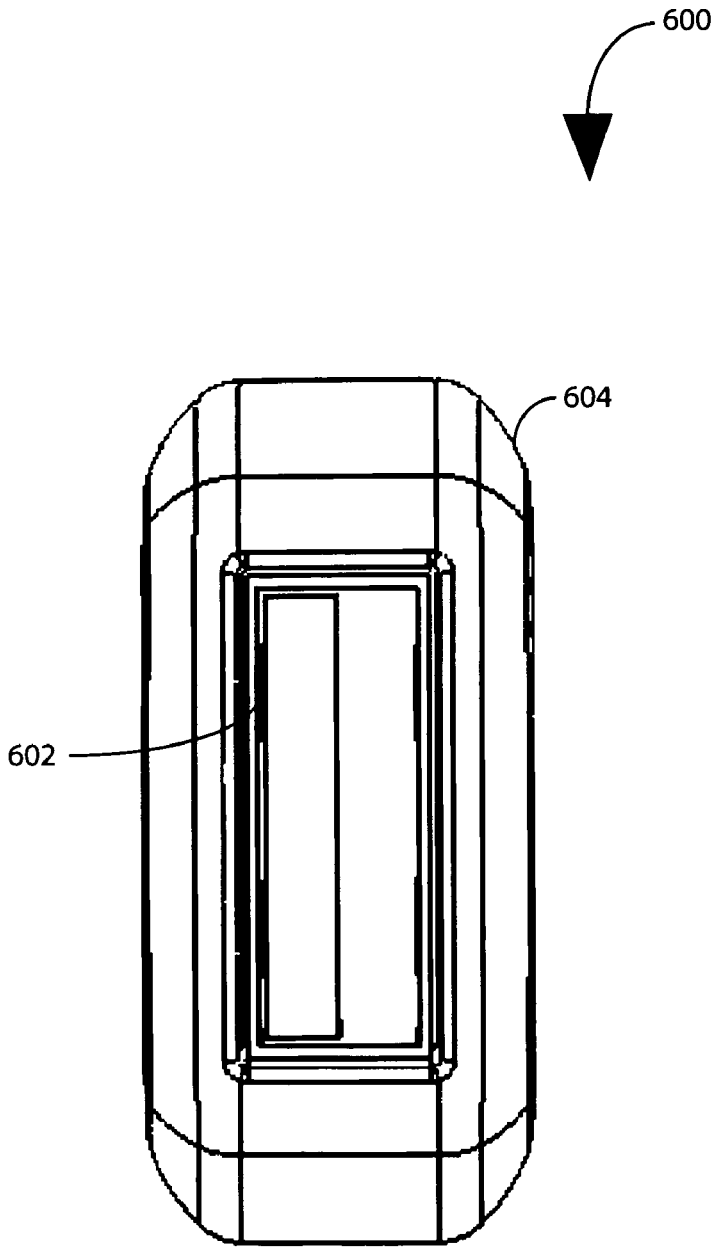
FIG. 6 is a top plan view of the present invention showing the electronic device.

FIG. 6 shows a top plan view of the electronic device 600. The connector 602 is protected as the top case 604 covers the connector 602.

Figure 7:
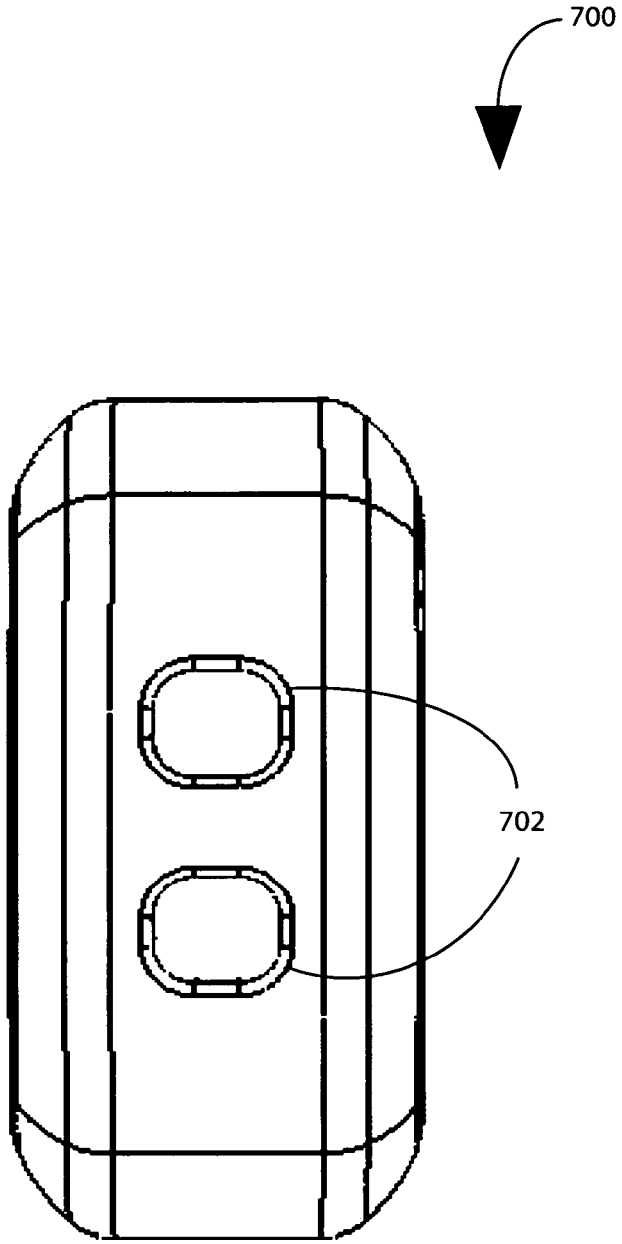
FIG. 7 is a bottom plan view of the present invention showing the electronic device.

FIG. 7 shows a bottom plan view of the current invention. The two holes 702 for the strap means may keep the electronic device 700 secure and easy for carrying.

Figure 8:
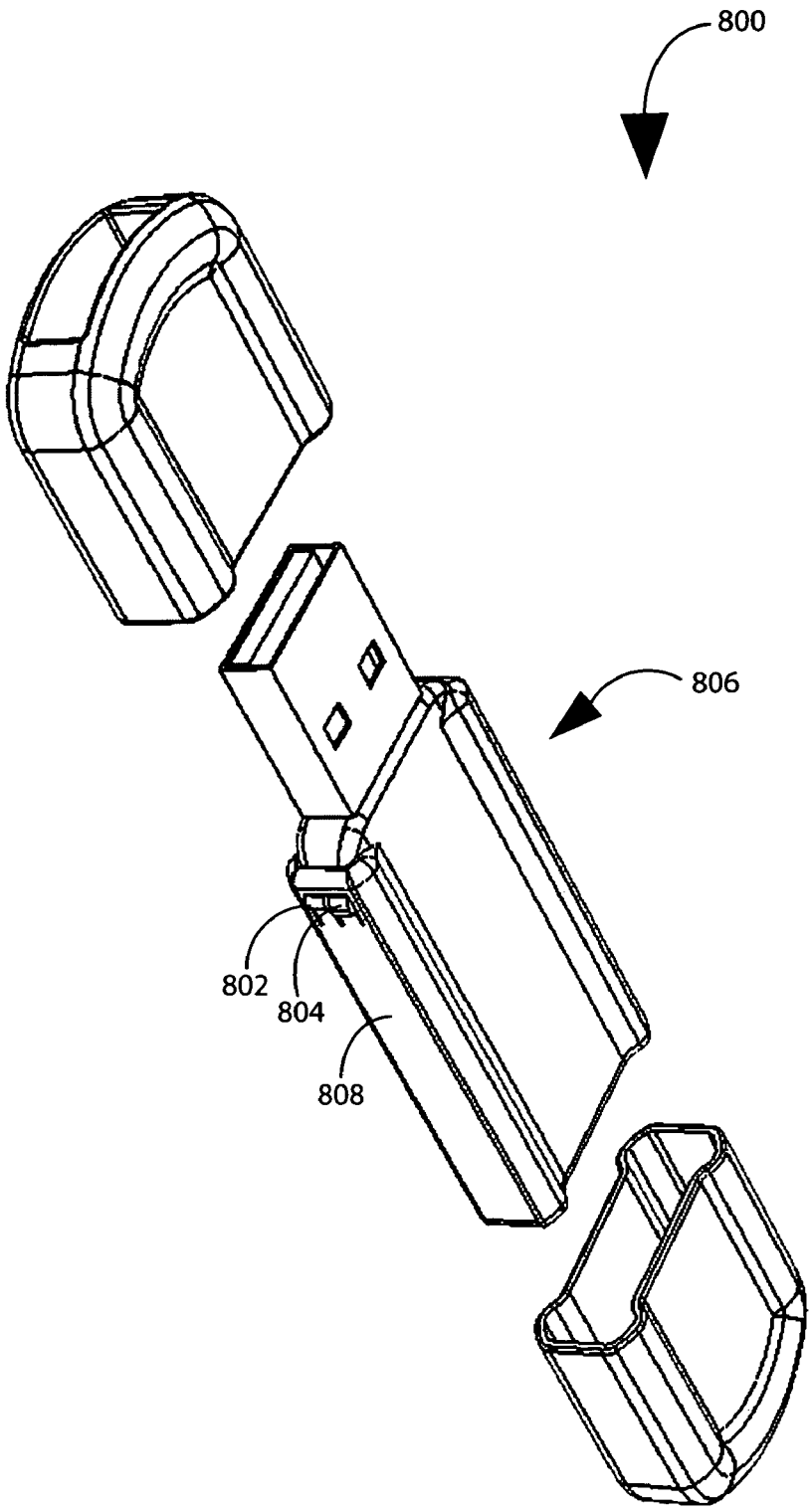
FIG. 8 is an exploded view of the present invention showing the electronic device.

FIG. 8 shows an exploded view of the electronic device 800. Finally, as it can be seen from FIG. 8, the electronic device 800 further comprises a first cantilever locking arm 802 on at least one side 808 of the main body 806 and a second cantilever retaining arm 804 on the at least one side 808 of the main body 806 along with the first cantilever locking arm 802.

Figure 9:
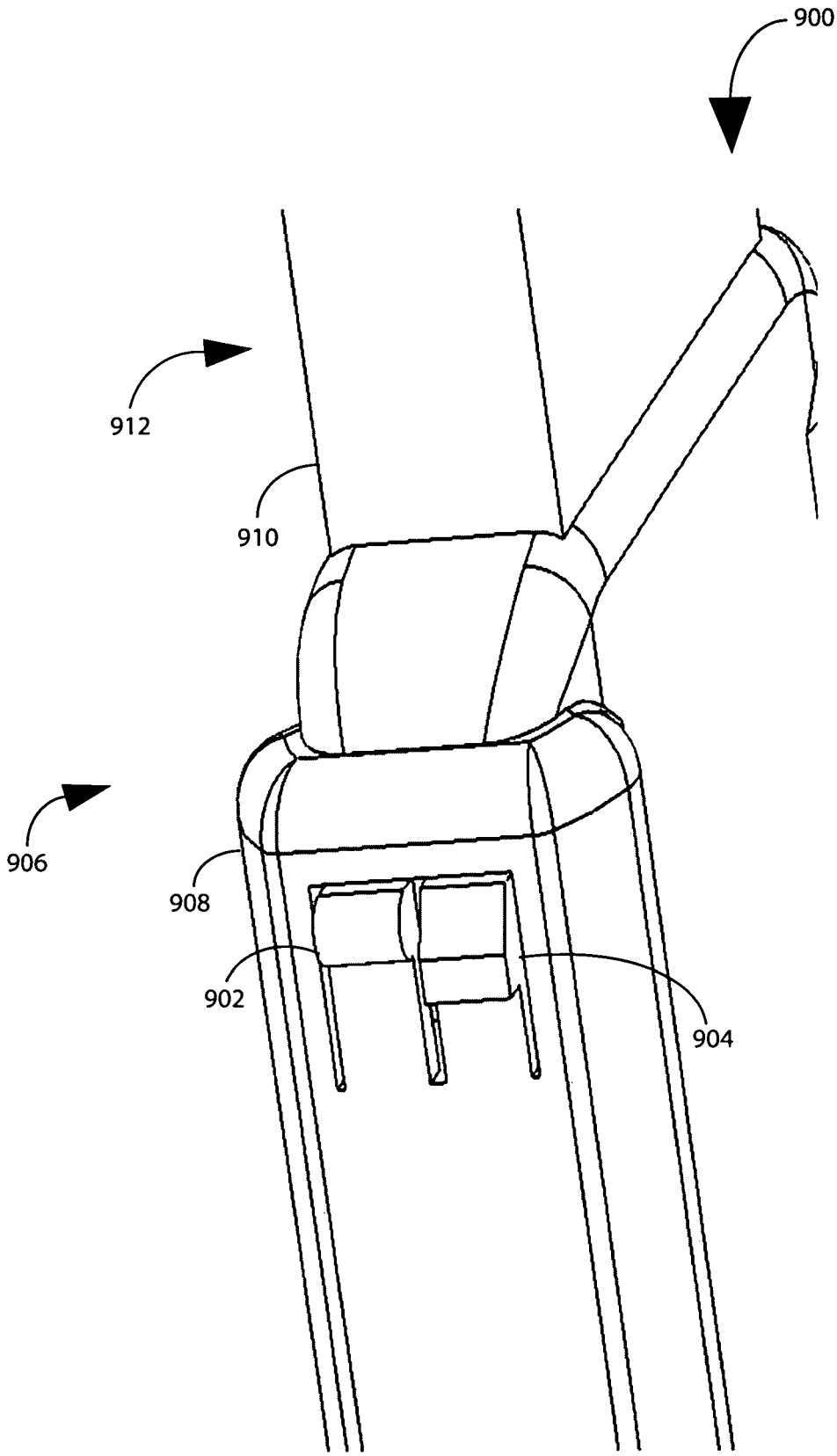
FIG. 9 is an enlarged view of the present invention showing the main body.

FIG. 9, an enlarged view of the present invention, shows in detail, the first cantilever locking arm 902 and second cantilever retaining arm 904 on the main body 906.

First cantilever locking arm 902 may include an open locking mechanism and a close locking mechanism for maintaining the top case 908 in the open state 912 and the closed state (not shown) respectively. Second cantilever retaining arm 904 may retain the top case 908 on the main body 906.

The first cantilever locking arm 902 and second cantilever retaining arm 904 are strong enough that when the connector 910 is covered, the top case 908 will not accidentally slide back towards the bottom case (not shown).

The main body 906 in the present invention is a USB drive. Moreover, the USB drive in this current exemplary embodiment may be in various capacities and may be in different color.

Figure 10:
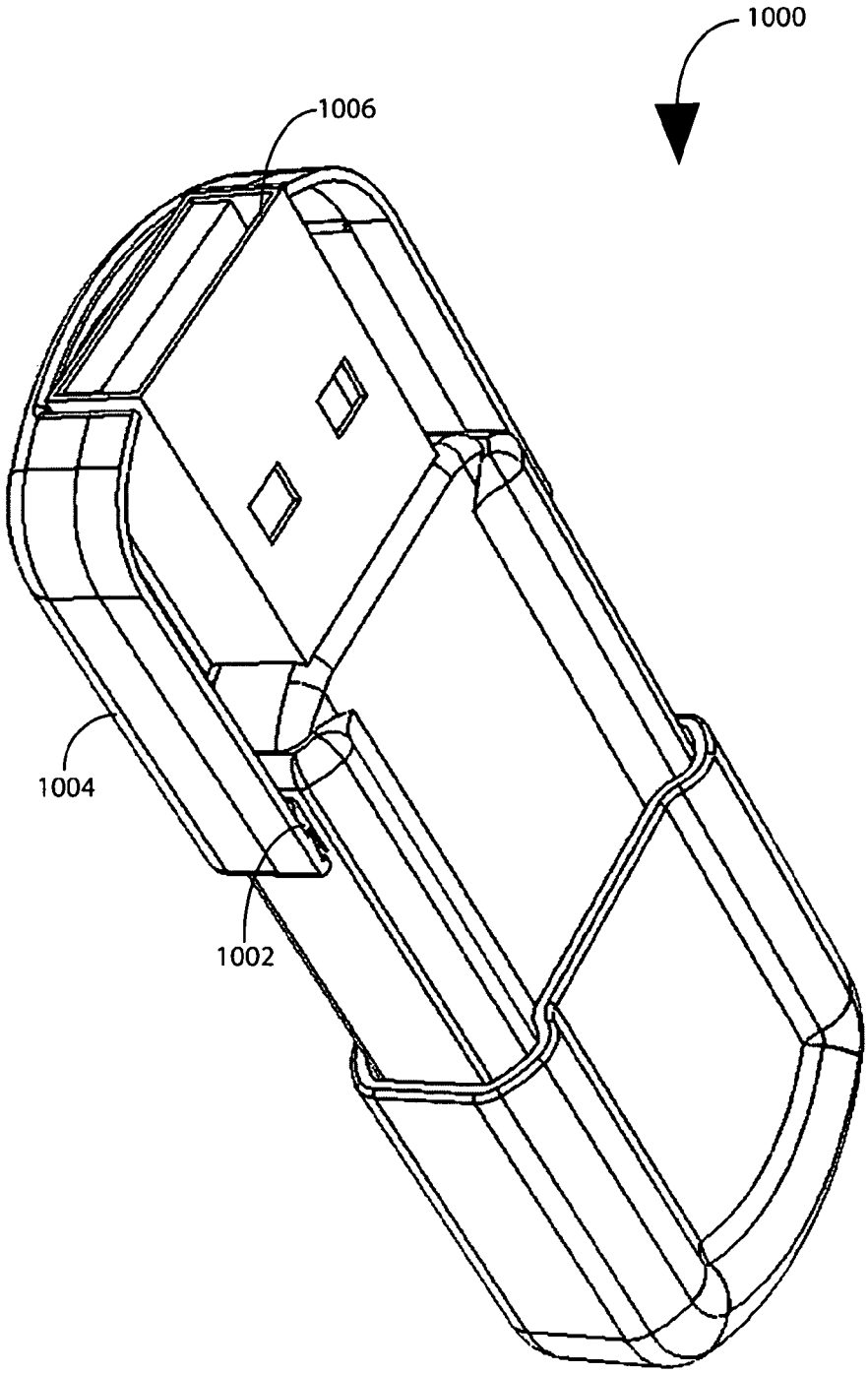
FIG. 10 is a perspective view of the electronic device as shown in FIG. 2, the upper case being slid over the second cantilever retaining arm.

FIG. 10 shows a perspective view of the electronic device 1000 in accordance with the present invention.

FIG. 10 also shows the second cantilever retaining arm 1002 onto which the top case 1004 slides. For the purpose of illustration, only the second cantilever retaining arm 1004 is shown, the corresponding first cantilever locking arm may be located along with the second cantilever retaining arm 1004.

The connector 1006 in the present invention is consistent with one of Universal Serial Bus (USB) specifications and IEEE (Institute of Electrical and Electronics Engineers) 1394 specifications.

The foregoing description of the preferred embodiment of the present invention has been presented for the purpose of illustration and description. It is not intended to be exhaustive or to limit the invention to the precise form disclosed. Many modifications and variations are possible in light of the above teachings. It is intended that the scope of the present invention not be limited by this detailed description, but by the claims and the equivalents to the claims appended hereto.

What is claimed is:

1. An electronic device for connecting to an external device, said electronic device comprising:

a main body having an on-board memory for storing digital information and a connector positioned at a proximal end of the main body, said connector being coupled to said on-board memory;

a main body is stationary and a top case is movable;

a bottom case coupled to said main body at a distal end thereof;

a top case slidably located opposite to said bottom case;

a first cantilever locking arm on at least one side of said main body, wherein said first cantilever locking arm maintains the top case in either the open state or closed state;

a second cantilever retaining arm on at least one said side of said main body along with said first cantilever locking arm, wherein said second cantilever retaining arm retains the top case to the main body; and wherein said top case is slid towards at least one end of said main body to expose and protect said connector.

2. The electronic device of claim 1, wherein said first cantilever locking arm includes an open locking mechanism and a close locking mechanism for maintaining said top case in an open state and a closed state respectively.

3. The electronic device of claim 1, wherein said second cantilever retaining arm is adapted to retain said top case on said main body.

4. The electronic device of claim 1, wherein said top case is moved towards said bottom case to expose said connector and achieve said open state.

5. The electronic device of claim 1, wherein said top case and said bottom case are immediately adjacent to each other in said open state.

6. The electronic device of claim 1, wherein said top case is slid towards said connector to cover said connector and achieve said closed state.

7. The electronic device of claim 1, wherein said top case and said bottom case are distally separated when said top case is in said closed state.

8. The electronic device of claim 1, a LED (LED's) embedment with main body.

9. The electronic device of claim 1, wherein said bottom case includes two holes, each for receiving a strap means for carrying said electronic device.

10. The electronic device of claim 1, wherein said connector is consistent with all kinds of connectors and interfaces.

11. The electronic device of claim 1, wherein said main body is a USB drive.

12. An electronic device for connecting to an external device, said electronic device comprising:

a main body having an on-board memory for storing digital information and a connector positioned at a proximal end of the main body, said connector being coupled to said on-board memory;

a main body is stationary and a top case is movable;

a bottom case coupled to said main body at a distal end thereof;

a top case slidably insertable into said bottom case;

a first cantilever locking arm on at least one side of said main body, wherein said first cantilever locking arm maintains the top case in either the open state or closed state;

a second cantilever retaining arm on at least one said side of said main body along with said first cantilever locking arm, wherein said second cantilever retaining arm retains the top case to the main body; and wherein said top case is slid towards at least one end of said main body to expose and protect said connector.

* * * * *